US007806739B2

(12) United States Patent
Hu et al.

(10) Patent No.: US 7,806,739 B2
(45) Date of Patent: Oct. 5, 2010

(54) BATTERY CONNECTOR WITH TIME-DELAY FUNCTION

(75) Inventors: Lan-Ping Hu, Shenzhen (CN); Yong-Hui Hu, Shenzhen (CN); Da-Yong Tong, Shenzhen (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/616,176

(22) Filed: Nov. 11, 2009

(65) Prior Publication Data

US 2010/0120291 A1 May 13, 2010

(30) Foreign Application Priority Data

Nov. 13, 2008 (CN) ..... 2008 2 0302763

(51) Int. Cl.
*H01R 4/48* (2006.01)

(52) U.S. Cl. ..... 439/862

(58) Field of Classification Search ..... 439/862, 439/924.1, 500

See application file for complete search history.

(56) References Cited

U.S. PATENT DOCUMENTS

| | | | | |
|---|---|---|---|---|
| 4,510,553 | A * | 4/1985 | Faultersack | 361/788 |
| 6,565,371 | B1 * | 5/2003 | Watanabe | 439/138 |
| 7,381,086 | B1 * | 6/2008 | Gilmore et al. | 439/500 |
| 2002/0106926 | A1 * | 8/2002 | Lindberg et al. | 439/342 |

FOREIGN PATENT DOCUMENTS

| | | |
|---|---|---|
| CN | 101212096 | 7/2008 |

* cited by examiner

*Primary Examiner*—Phuong K Dinh
(74) *Attorney, Agent, or Firm*—Wei Te Chung; Andrew C. Cheng; Ming Chieh Chang

(57) ABSTRACT

A battery connector (100) includes an insulative housing (10) and a power contact (30A), a signal contact (30B) and a grounding contact (30C) received in the insulative housing. The insulative housing defines a mating face (101). Each of the power contact, the signal contact and the grounding contact has a contacting portion (307) extending out of the mating face of the insulative housing. A distance from the contacting portion of the power contact to the mating face is larger than a distance from the contacting portion of the signal contact to the mating face.

2 Claims, 5 Drawing Sheets

BATTERY CONNECTOR WITH TIME-DELAY FUNCTION

BACKGROUND OF THE INVENTION

1. Field of the Invention

The present invention relates generally to a battery connector, and more particularly to a battery connector with time-delay function.

2. Description of Related Arts

A battery is widely used in electric appliances, such as computers, mobile phones, etc., for providing power for the same. Correspondingly, a battery connector has already been widely arranged in such electric appliances. A battery connector usually includes an insulative housing and a plurality of contacts received in the insulative housing. The insulative housing usually defines an assembling face attaching to a printed circuit board and a mating face coupling with a battery. The insulative housing defines a plurality of passageways extending through the assembling face and the mating face for receiving the contacts. The contact is equipped with a soldering part, a retaining part which consecutively connects with the soldering part and is retained in the insulative housing, a contact part, and an elastically deformed part coupling between the retaining part and the contact part. When the battery is assembled to the battery connector, the battery meets with the contact parts of the contacts first, and presses against the contact parts to deform the deformed parts when the battery is pushed deeper. The deformed parts have elasticity and keep the battery in a right position responding to the elasticity.

As is well known to a person skilled in the art, the contacts of the battery connector include at least one power contact, at least one signal contact, and at least one grounding contact. However, the at least one power contact, the at least one signal contact, and the at least one grounding contact have same distances to the mating face of the insulative housing, which means that when the battery is assembled, the battery synchronously contacts with the three kinds of contacts. When the battery is ejected therefrom, the battery synchronously disconnects from the three kinds of contacts. Signals carried on the computer or the mobile phone, etc., are prone to loss when the battery synchronously disconnects from the power contact and the signal contact.

Hence, a battery connector with time-delay function for preventing signals loss is desired.

SUMMARY OF THE INVENTION

Accordingly, an object of the present invention is to provide a battery connector with time-delay function for preventing signals loss.

To achieve the above object, a battery connector includes an insulative housing and a power contact, a signal contact and a grounding contact received in the insulative housing. The insulative housing defines a mating face. Each of the power contact, the signal contact and the grounding contact has a contacting portion extending out of the mating face of the insulative housing. A distance from the contacting portion of the power contact to the mating face is larger than a distance from the contacting portion of the signal contact to the mating face.

Other objects, advantages and novel features of the invention will become more apparent from the following detailed description when taken in conjunction with the accompanying drawings.

DETAILED DESCRIPTION OF THE PREFERRED EMBODIMENT

Referring to FIGS. 1-4, a battery connector 100 of the present invention, used for connecting with a battery (not shown) and a printed circuit board (PCB, not shown), includes an insulative housing 10, a plurality of contacts 30 received in the insulative housing 10, and a pair of reinforcing elements 50 interlocking in the insulative housing 10 for positioning the insulative housing 10 onto the PCB. The contacts 30 of the present embodiment include a power contact 30A, a grounding contact 30C, and a signal contact 30B located between the power contact 30A and the grounding contact 30C.

Figure 1:
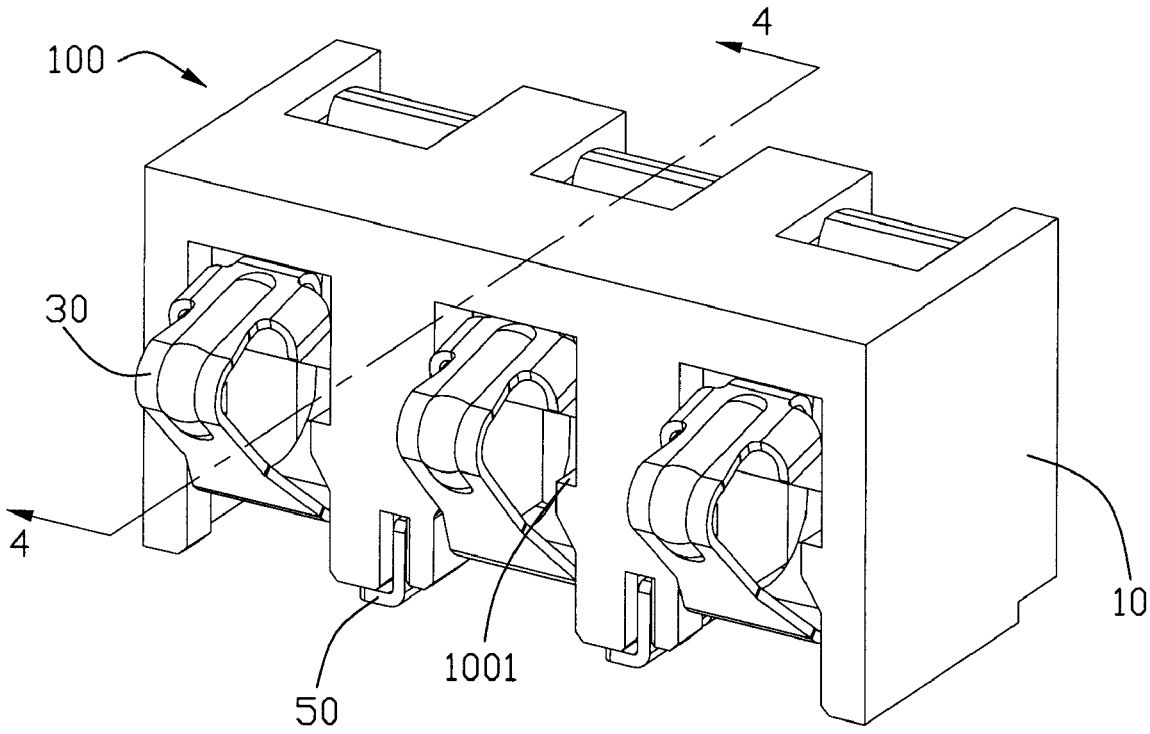
FIG. 1 is a perspective, assembled view of a battery connector constructed in accordance with the present invention.
Figure 2:
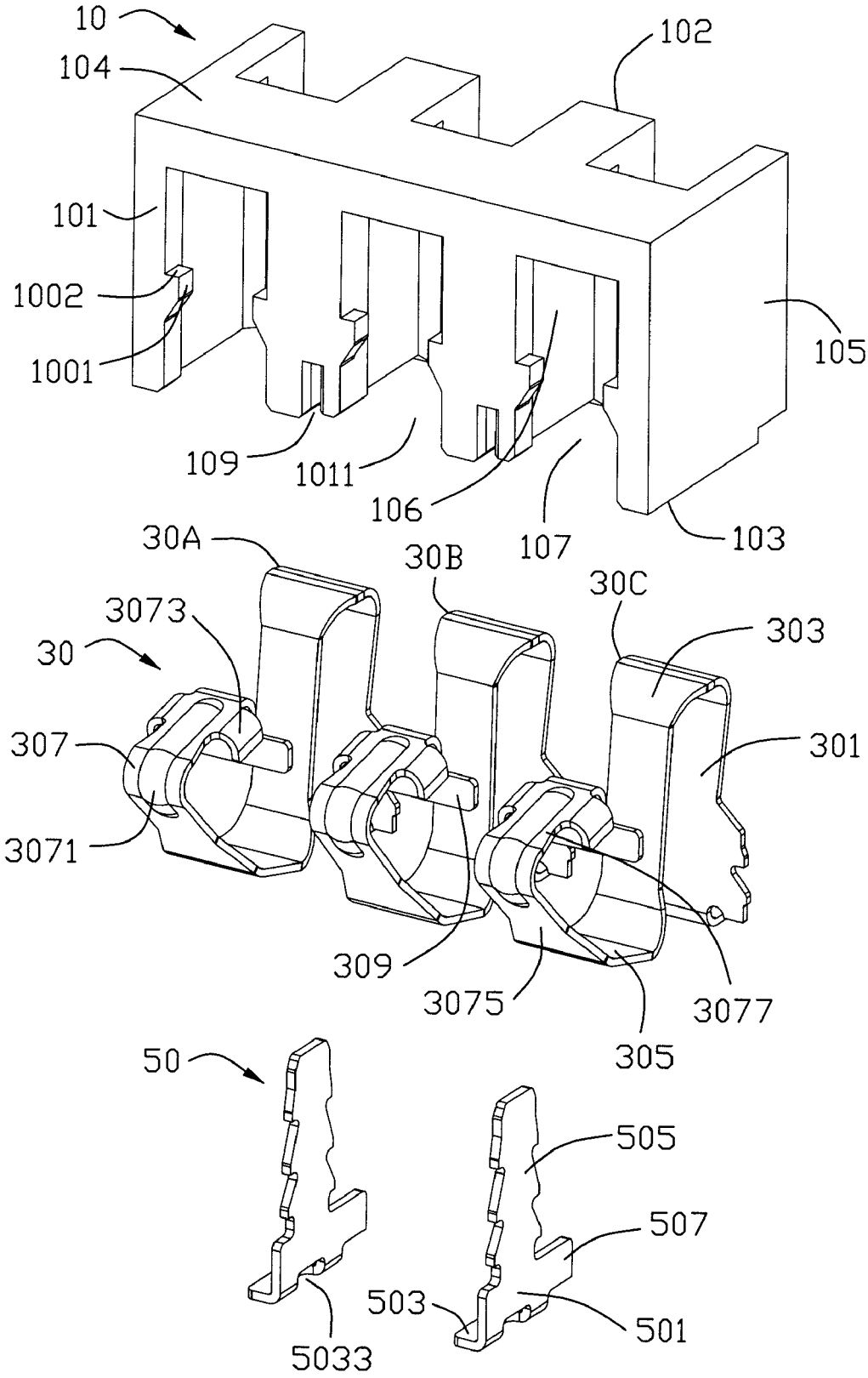
FIG. 2 is a perspective, exploded view of the battery connector of FIG. 1.

Referring to FIG. 2, the insulative housing 10 is rectangular and has a mating face 101 coupling with the battery, a rear face 102 opposite to the mating face 101, an assembling face 103 attaching to the PCB, an upper face 104 opposite to the assembling face 103, and a pair of lateral walls 105 connecting with the mating face 101, the rear face 102, the assembling face 103, and the upper face 104. The insulative housing 10 comprises a pair of dividing walls 106 the same as the lateral walls 105 connecting with the mating face 101, the rear face 102, the assembling face 103, and the upper face 104. Each dividing wall 106 and the adjacent lateral wall 105, as well as the pair of dividing walls 106, define three passageways 107 for the contacts 30. The mating face 101 defines three cutouts 1011 each communicating with the passageway 107. The contacts 30 extend out of the mating face 101 of the insulative housing 10 through the cutouts 1011 for coupling with the battery. Each cutout 1011 has a width smaller than that of the passageway 107. Three pairs of protrusions 1001 are formed on the opposite sides of the dividing walls 106 as well as an inner side of the lateral walls 105, respectively extending into each cutout 1011. Each protrusion 1001 defines a confronting surface 1002 at an upper surface thereof Each dividing wall 106 defines a slit 109 receiving the reinforcing element 50.

Figure 3:
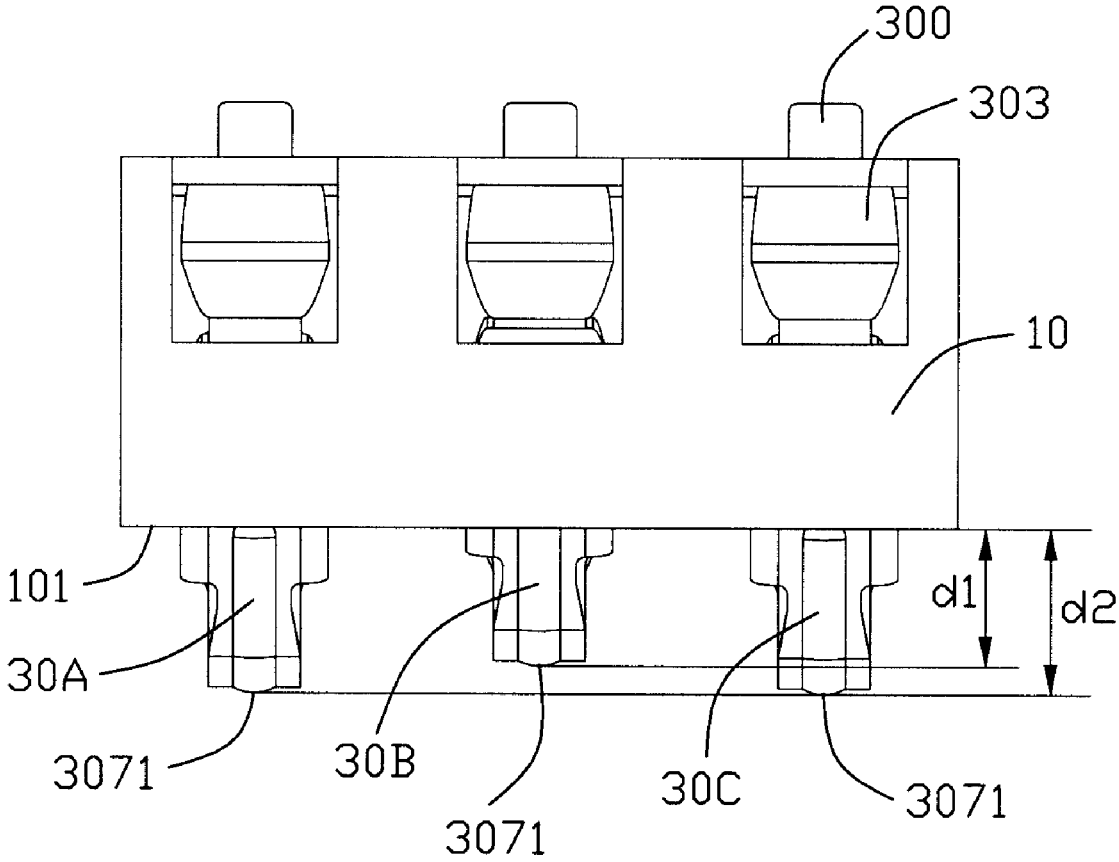
FIG. 3 is a top view of the battery connector.

Referring to FIGS. 2-3, the power contact 30A, the grounding contact 30C, and the signal contact 30B are made from metal material and each has an approximately "S" shape. Each contact 30 comprises a soldering pad 300, a retaining pad 301, a first curved portion 303, a second curved portion 305, a contacting portion 307, and a locked portion 309. The soldering pad 300 extends out of the insulative housing 10 from the rear face 103. The retaining pad 301 consecutively connects with the soldering pad 300 and is vertically retained in the insulative housing 10. The first curved portion 303 consecutively connects with the retaining pad 301, bends towards the assembling face 103 at the upper face 104, and forms an inverted "U" shape together with the retaining pad 301. The second curved portion 305 consecutively connects with the first curved portion 303 and bends towards the mating face 101 from the assembling face 103. The contacting portion 307 connects with the second curved portion 305 and the locked portion 309. The contacting portion 307 is V-shaped facing to the retaining pad 301 and comprises a first arm 3075 and a second arm 3077 to form an intersection point 3071. The contacting portion 307 extends out of the insulative housing 10 from the cutout 1011 of the mating face 101 to couple with the battery. The intersection point 3071 of the power contact 30A has a distance to the mating face 101 greater than that of the intersection point 3071 of the signal contact 30B, so that the intersection point 3071 of the power contact 30A contacts with the battery prior to the intersection point 3071 of the signal contact 30B. In a preferred embodiment, the intersection point 3071 of the grounding contact 30C has a distance to the mating face 101 same as the intersection point 3071 of the power contact 30A. The locked portion 309 extends transversely with respect to the contacting portion 307 and has the largest width among the soldering pad 300, the retaining pad 301, the first curved portion 303, the second curved portion 305, and the contacting portion 307. The second arm 3077 comprises a pair of wing portions 3073 extending laterally into a V-shaped cavity (not labeled) defined by the contacting portion 307. The wing portions 3073 are smooth and prevent scrapping to other elements.

Figure 4:
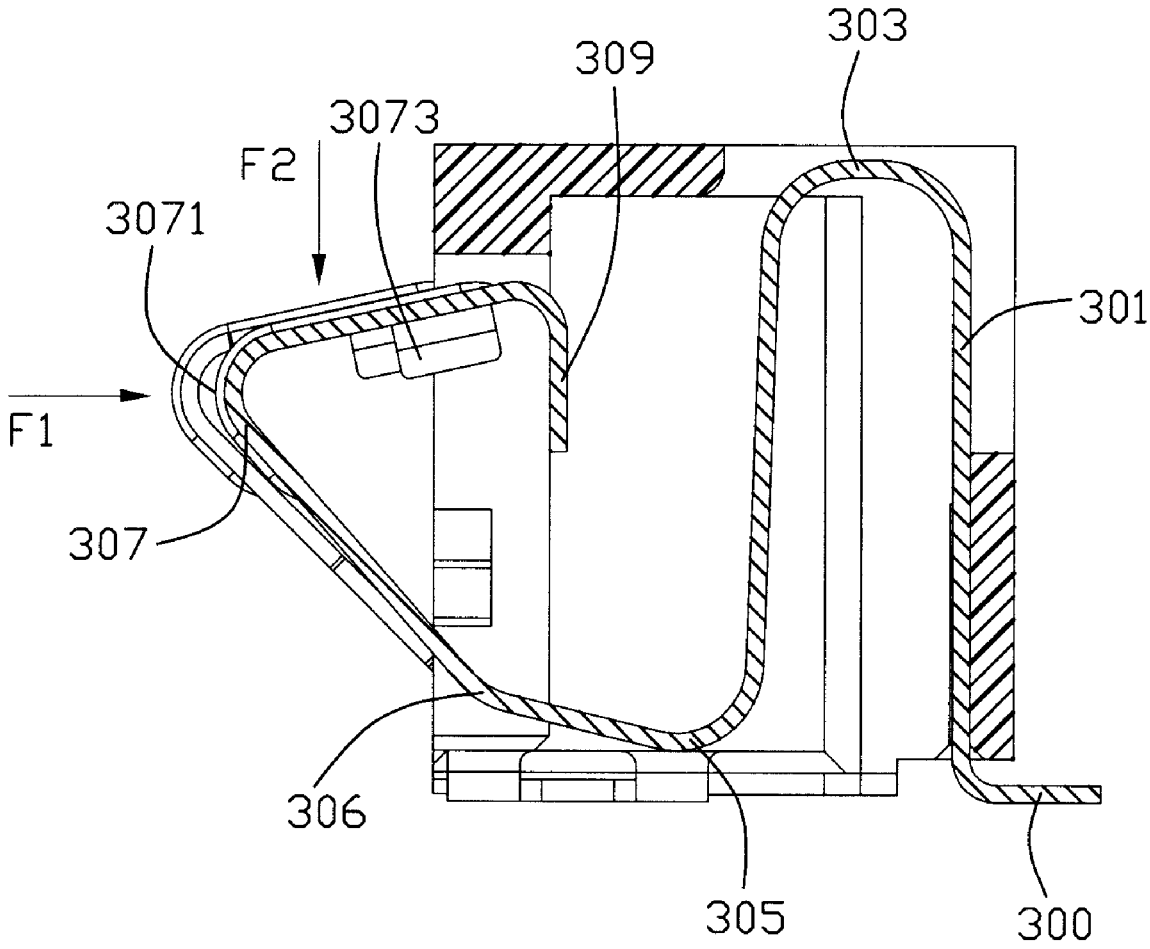
FIG. 4 is a cross-section view of the battery connector taken along line A-A of FIG. 1.

Referring to FIGS. 3-4, a distance between the contacting portion 3071 of the signal contact 30B and the mating face 101 is defined as d1 and a distance between the contacting portions 3071 of the power contact 30A and the mating face 101 is defined as d2, which is longer than d1. The distance between the contacting portions 3071 of the grounding contact 30C and the mating face 101 is d2, too. When the battery is assembled to the battery connector 100 along a mating direction F1, shown in FIG. 4, the battery contacts with the contacting portions 3071 of the power contact 30A and the grounding contact 30C first, but not contact with the contacting portion 3071 of the signal contact 30B. When the battery is pushed deeper, the battery contacts with the contacting portion 3071 of the signal contact 30B. Thereby, electrical connection is achieved between the battery and the battery connector 100. In the ejection of the battery, the battery first disconnects from the contacting portion 3071 of the signal contact 30B but still connects with the contacting portion 3071 of the power contact 30A, which still powers to the mobile phone and prevents signals lost. Simply speaking, the battery connector 100 has time-relay function. When the battery is inserted to a certain degree along a falsely direction shown as F2, the wing portions 3073 of the contacts 30 confront the protrusions 1001 and the battery is prevented from inserting along such false direction F2 excessively. Accordingly, the contacts 30 are prevented from being damaged.

The reinforcing elements 50 are made of metal material. Each reinforcing element 50 comprises a base portion 501, an inserting portion 505 extending upwardly from the base portion 501, a soldering portion 503 extending downwardly from base portion 501, and a fixing portion 507 extending laterally from the base portion 507. The base portion 501, the inserting portion 505, and the fixing portion 507 extend in a vertical plane while the soldering portion 503 extends in a horizontal plane. The soldering portion 503 defines an aperture 5033 for receiving adhesive material to solder with the PCB.

Figure 4A:
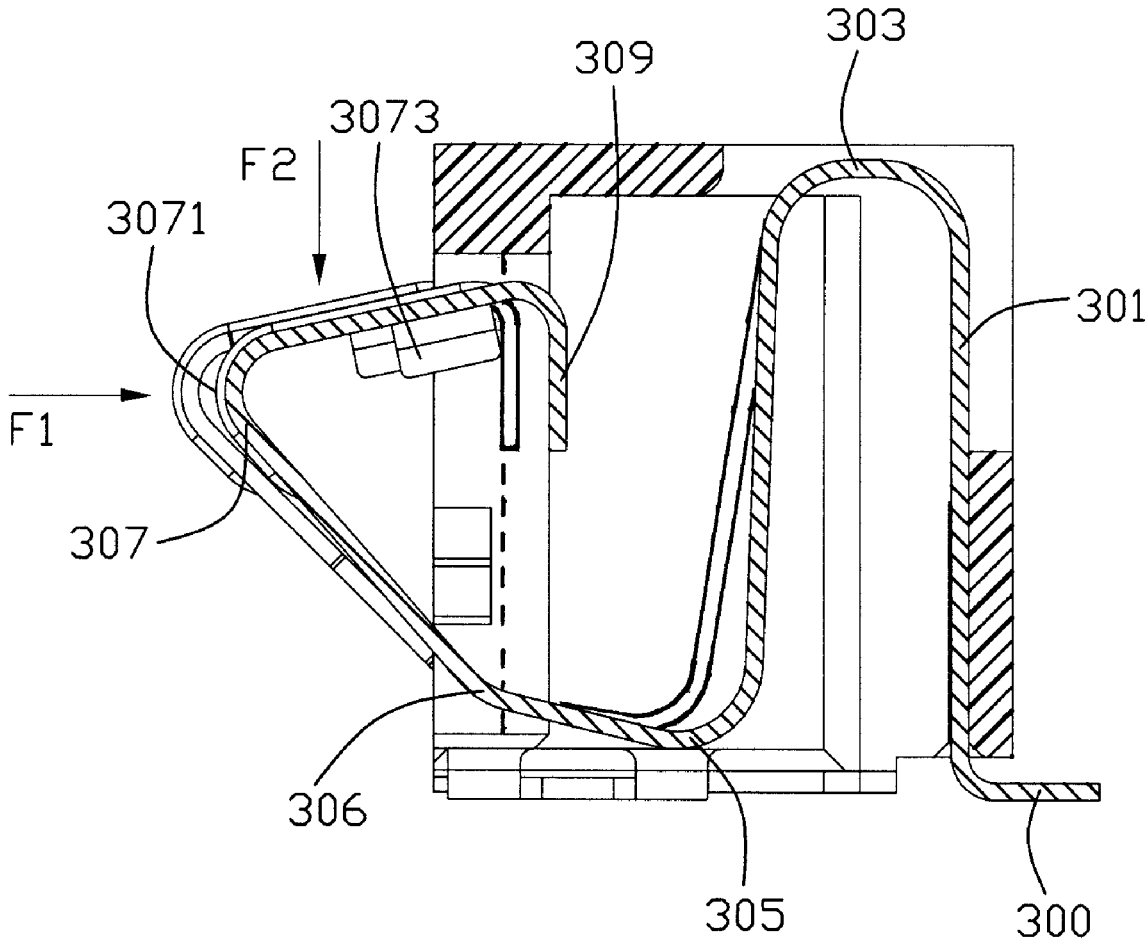
FIG. 4A is the illustrative cross-section view of FIG. 4 showing how the same configured power and signal contacts may be positioned different relative to each other in a mating direction as shown in FIG. 3 due to the different depths of the preloading step in the corresponding passageways in which the power and the signal contacts are respectively located.

FIG. 4A essentially shows how the same configured power contact 30A and the signal contact 30B are positioned different relative to each other in the mating direction as shown in FIG. 3, i.e., d2 vs. d1 due to different depths of the steps (not labeled) in the corresponding passageways 10, which abuts against the corresponding locking portion 309 for preloading the corresponding contacts 30A/30B in the corresponding passageways 307, respectively, so as to have the power contact 30A and the signal contact 30B both be in a tensioned/preloaded manner wherein tension in signal contact 30B is larger than that of the power contact 30A.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A battery connector comprising:

an insulative housing defining a mating face; and a power contact, a signal contact and a grounding contact received in the insulative housing, each contact forming a contacting portion extending out of the mating face of the insulative housing;

wherein a distance from the contacting portion of the power contact to the mating face is larger than a distance from the contacting portion of the signal contact to the mating face, wherein the signal contact is located between the power contact and the grounding contact, wherein a distance from the contacting portion of the grounding contact to the mating face is same as the distance from the contacting portion of the power contact to the mating face, wherein the insulative housing defines an assembling face perpendicular to the mating face, wherein the insulative housing comprises a pair of lateral walls and a pair of dividing walls parallel with the lateral walls, and wherein the lateral walls and the dividing walls define three passageways, further comprising a pair of reinforcing elements, and wherein each dividing wall defines a slit and each reinforcing element is received in a corresponding slit, wherein the insulative housing has a plurality of protrusions extending into the passageways and the contacting portions of the power contact, the signal contact, and the grounding contact each form a pair of wing portions opposing the protrusions, wherein each of the power contact, the signal contact, and the grounding contact has a soldering pad extending out of the insulative housing, a retaining pad retained in the insulative housing, an S-shaped curved portion connecting with the retaining pad and the contacting portion, and a locked portion connecting to the contacting portion, wherein the S-shaped curved portion comprises a first curved portion bending towards the assembling face at the upper face and a second curved portion bending towards the mating face at the assembling face.

2. A battery connector comprising: an insulative housing defining a front mating face and first and second passageways side by side arranged with each other, each of said passageways being equipped with a front opening in said front mating face with a step structure adjacent thereto; one power contact and a signal contacts respectively located in the first passageways and the second passageway, each of said power contact and said signal contact defining a V-shaped contact section for forward engagement with a battery, which is correctly horizontally mated said contact section, with thereof a locking portion at a free end for abutment against the corresponding step structure for preloading consideration, both of said power and signal contacts being installed into the corresponding passageways with corresponding contact sections forwardly protruding out of the front mating face, wherein the housing includes a pair of protrusions in each passageway around the front mating face and each of said power contact and said signal contact includes a pair of wing portions adapted to be downwardly engaged with the corresponding protrusions when the corresponding contact is improperly downwardly pressed by an incorrectly assembled battery in a vertical direction; wherein the insulative housing comprises a pair of lateral walls and a pair of dividing walls parallel with the lateral walls to commonly define said first and second passageways; wherein a pair of reinforcing elements with soldering portions thereon, are disposed on a bottom face of the housing.

* * * * *